US011130552B2

(12) United States Patent
van Dillen

(10) Patent No.: US 11,130,552 B2
(45) Date of Patent: Sep. 28, 2021

(54) UNDERWATER RECREATION SYSTEM

(71) Applicant: Tiemen Tobias van Dillen, Moosburg (AT)

(72) Inventor: Tiemen Tobias van Dillen, Moosburg (AT)

( * ) Notice: Subject to any disclaimer, the term of this patent is extended or adjusted under 35 U.S.C. 154(b) by 502 days.

(21) Appl. No.: 15/753,977

(22) PCT Filed: Aug. 19, 2016

(86) PCT No.: PCT/US2016/047683
§ 371 (c)(1),
(2) Date: Feb. 21, 2018

(87) PCT Pub. No.: WO2017/034939
PCT Pub. Date: Mar. 2, 2017

(65) Prior Publication Data

US 2018/0244359 A1 Aug. 30, 2018

Related U.S. Application Data

(60) Provisional application No. 62/208,679, filed on Aug. 22, 2015.

(51) Int. Cl.

| | |
|---|---|
| ***B63C 11/20*** | (2006.01) |
| ***B63C 11/30*** | (2006.01) |
| ***B63B 22/18*** | (2006.01) |
| ***B63B 22/20*** | (2006.01) |
| ***B63C 11/02*** | (2006.01) |

(52) U.S. Cl.
CPC ..... *B63C 11/207* (2013.01); *B63B 22/18* (2013.01); *B63B 22/20* (2013.01); *B63C 11/30* (2013.01); *A63B 2225/605* (2013.01); *B63C 2011/026* (2013.01); *B63C 2011/028* (2013.01); *B63C 2011/303* (2013.01)

(58) Field of Classification Search
CPC ..... B63C 2011/026; B63C 2011/028; B63C 11/14; B63C 11/16; B63C 2011/165; B63C 11/18; B63C 11/20; B63C 11/202; B63C 11/205; B63C 11/207; B63C 11/22; B63C 11/30; B63C 2011/303; B63B 22/18; B63B 22/20; A63B 2071/0694; A63B 2225/605; A63B 31/08
See application file for complete search history.

(56) References Cited

U.S. PATENT DOCUMENTS 3,370,586 A * 2/1968 Aragona ..... B63C 11/207 128/201.11
4,092,756 A * 6/1978 Stier ..... B63C 11/02 114/244

(Continued)

FOREIGN PATENT DOCUMENTS

WO WO-03024778 A1 * 3/2003 ..... B63C 11/205

*Primary Examiner* — Ajay Vasudeva

(57) ABSTRACT

An underwater recreation system for diving instruction and method of its use. The method includes providing a series of learning steps with diving techniques and instructions to practice at incrementally deeper depths and providing a surface floating depth limitation device that restricts the learning user to the particular maximum depth of their learning step. The apparatus for carrying out the method of diving instruction includes a surface floating depth limitation device with the means to connect to the breathing hose of a surface supplied air supply.

11 Claims, 6 Drawing Sheets

(56) References Cited

U.S. PATENT DOCUMENTS

| | | | | | |
|---|---|---|---|---|---|
| 4,986,267 | A * | 1/1991 | Doss | B63C 11/202 | 128/201.27 |
| 5,193,530 | A * | 3/1993 | Gamow | B63C 11/14 | 128/201.27 |
| 5,906,200 | A * | 5/1999 | Kaburaki | B63B 27/146 | 128/201.27 |
| 2004/0086838 | A1 * | 5/2004 | Dinis | G09B 19/00 | 434/247 |

* cited by examiner

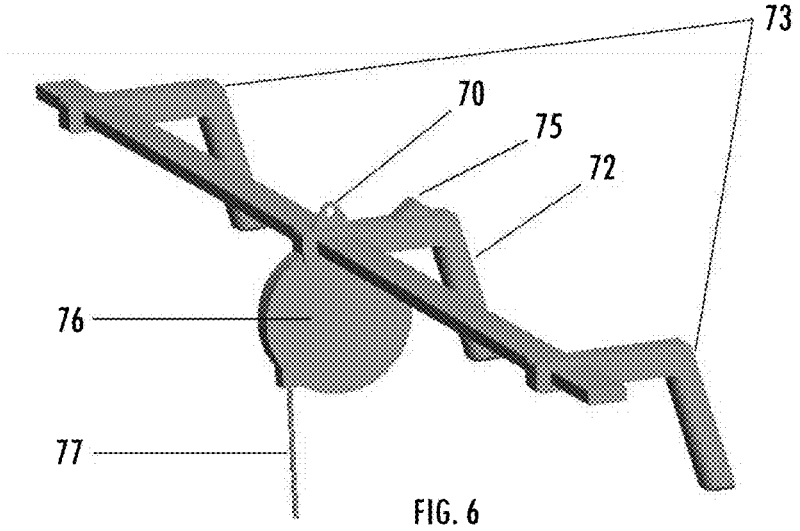
FIG. 6
FIG. 7A
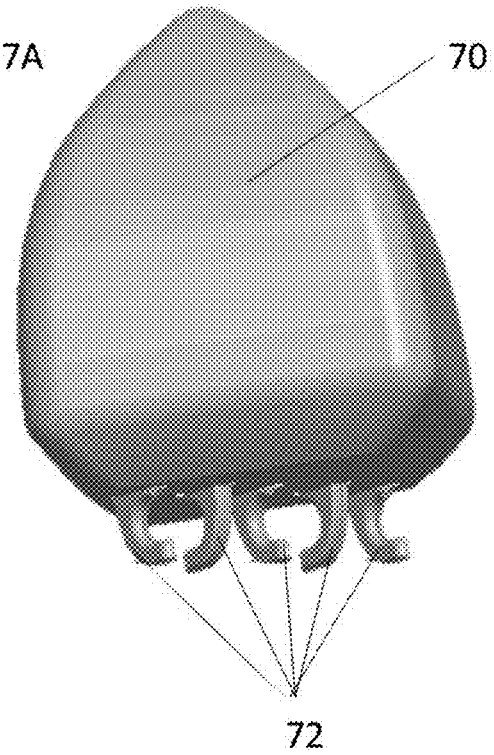
FIG. 7B
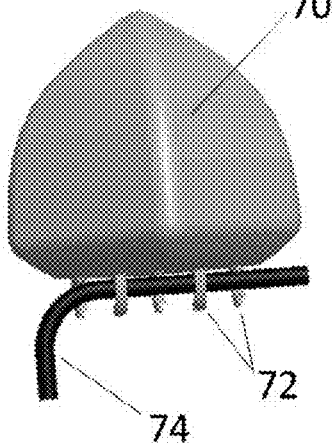
FIG. 7C
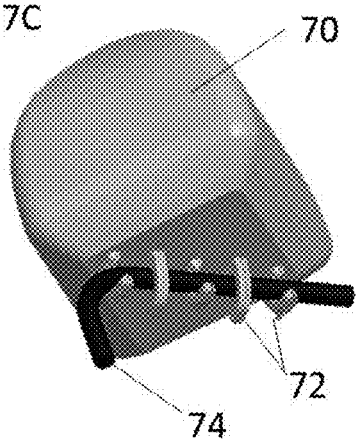

UNDERWATER RECREATION SYSTEM

CROSS-REFERENCE TO RELATED APPLICATIONS

This application claims the benefit of U.S. provisional patent application Ser. No. 62/208,679, filed 2015 Aug. 22 by the present inventor, which is incorporated by reference.

BACKGROUND OF THE DISCLOSURE

Field of the Disclosure

The present disclosure relates to an underwater recreation system as well as to a method of diving instruction.

Description of the Related Art

It is known to instruct people in the art of underwater recreation, e.g. using compressed air tanks (a.k.a. SCUBA diving) or using compressed air supplied from the surface through a hose. Three well-known types of recreational activities for enjoying an underwater experience are SCUBA (Self Contained Underwater Breathing Apparatus), snorkeling, and Hookah/surface supplied air diving.

SCUBA diving allows the user great underwater mobility and depths, but the equipment used is very heavy, cumbersome, and complex. They usually carry a heavy compressed air tank, a buoyancy control vest (BCD), ballast weights, breathing regulators, and a dive computer, among other equipment. It takes a significant amount of time and dedication to learn how to do safely and properly. The courses are typically quite theoretical, with some dedicated time in a protected area like a swimming pool to learn the key techniques before enjoying an open water experience in a real marine environment. Since the excitement of being underwater in a pool or shallow water quickly fades, the beginner divers are often taken to deeper open water before they are fully comfortable or before they have fully practiced the techniques to the point where they are second nature without thinking. With the deeper waters, the safety risks of SCUBA diving are greatly increased, which are especially dangerous for younger beginners such as children, whose level of comfort and resistance to panic may be easily overestimated.

Snorkeling does not require as much equipment as SCUBA diving, usually just a mask, a snorkel, and fins, however it doesn't give the full experience and mobility. A snorkeler breathes air from the surface underwater through a tube, and because the pressure of the surrounding water increases rapidly, is limited to a very shallow depth for breathing. This depth is typically at most 20-30 cm from the surface. A snorkeler continuously needs to return to the surface in order to breathe air, interrupting their underwater experience. Especially young or novice snorkel divers have a difficult time to stay underwater for longer periods of time and clear the water from their snorkel when they resurface.

Hookah or surface supplied air diving has been developed as modification of snorkeling where a separate air supply at the surface provides air at a higher than atmospheric pressure. Depending on the pressure provided, it allows tube or hose lengths and depths in excess of 20 m. The air supply system at the surface can be located on a boat or dock, or be contained on its own float. It can be based on a pressurized air reservoir that has been charged earlier, or it can be based on an active air pump. In the case it is based on an air pump, a variety of pump systems can be used depending on the pressure desired. The pump can be driven either electrically or through other means.

Surface supplied air diving provides a very similar experience to SCUBA diving, without the need for all the bulky and complex equipment, especially at shallower depths. However, it also has some of the same risks and hazards; among these, but not limited to:

- Panic or discomfort when loosing mouthpiece or getting water in mask while underwater.
- Panic or discomfort when encountering marine life while underwater.
- Rupture of the eardrum from failing to equalize the pressure.
- Rupture of the lung tissue (pulmonary barotrauma) from ascending too quickly or holding breath while ascending.

Therefore, the safe use of surface supplied air requires the knowledge, the comfort, and the capacity to perform some of the same techniques from SCUBA diving. Some surface supplied air systems provide a flotation vest for very young divers, which limits or prevents their exposure to the above risks. However, this also limits their underwater experience, and while it allows them to get comfortable with breathing through a regulator, it prevents them from safely learning and properly practicing many other SCUBA safety techniques. Alternatively, some users of surface supplied air systems or SCUBA diving will pair on advanced user with a novice user and submerge together arm in arm or hand in hand, however, this provides only limited safety, since after a while or several dives, the advanced user may get distracted and lose their grip. Or the novice user can panic and tear away, with the advanced user unable to react in time.

The present disclosure expounds upon this background.

SUMMARY OF THE PRESENT DISCLOSURE

The aim of the present summary is to facilitate understanding of the present disclosure. The summary thus presents concepts and features of the present disclosure in a more simplified form and in looser terms than the detailed description below and should not be taken as limiting other portions of the present disclosure.

Loosely speaking, the present disclosure teaches, inter alia, a system that limits a diver's depth to any one of a plurality of fixed depths, including a very shallow depth, e.g. less than one meter, and a somewhat less shallow depth, e.g. less than four meters. By limiting the maximum possible diving depth to a very shallow depth, even children can safely acquaint themselves with compressed air diving before progressing to deeper depths. By limiting the maximum possible diving depth to any one of a plurality of fixed depths, an instructor can ensure that a learning diver has acquired the skills necessary beyond a particular depth before allowing the learning diver to go to that depth. At the some time, the system permits considerable lateral movement so that the learning diver can enjoy the sensation of such underwater recreation.

The system loosely described above may be embodied in the form of an underwater recreation system, comprising: a first float; a first tether; a first interconnect that limits a range of movement of a first end of said first tether to within one meter of said first float; and a second interconnect that limits a range of movement of said first end of said first tether to within four meters of said first float.

Other objects, advantages and embodiments of the present disclosure will become apparent from the detailed description below, especially when considered in conjunction with the accompanying drawings.

BRIEF DESCRIPTION OF THE DRAWINGS

The Figures show:

FIG. 6 shows on embodiment of a component of an underwater recreation system in accordance with the present disclosure;

FIG. 7A shows details of on embodiment of on underwater recreation system in accordance with the present disclosure;

FIG. 7B shows details of on embodiment of on underwater recreation system in accordance with the present disclosure;

FIG. 7C shows the embodiment of FIG. 7B from a different perspective;

DETAILED DESCRIPTION

Figure 1A:
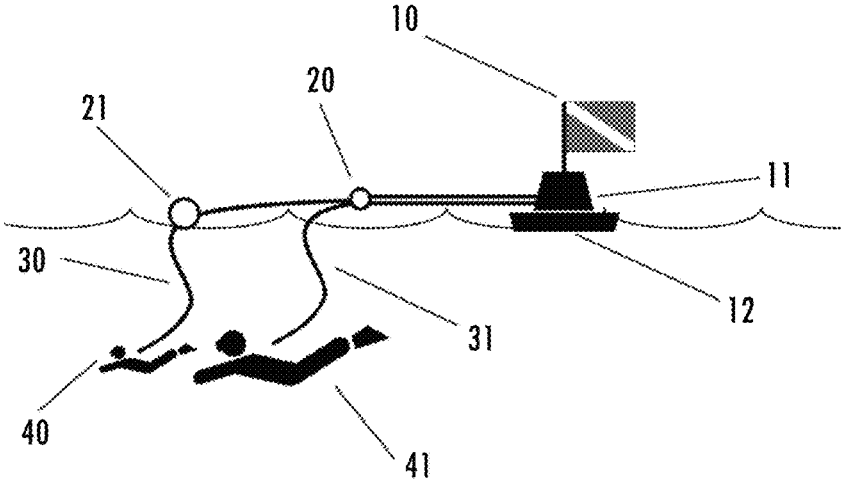
FIG. 1A shows an embodiment of an underwater recreation system in accordance with the present disclosure.

The various embodiments of the present disclosure and of the claimed invention, in terms of both structure and operation, will be best understood from the following detailed description, especially when considered in conjunction with the accompanying drawings.

Before elucidating the embodiments shown in the Figures, various embodiments of the present disclosure will first be described in general terms.

As touched upon above, the present disclosure teaches an underwater recreation system, comprising: a first float; a first tether; a first interconnect that limits a range of movement of a first end of the first tether to within one meter of the first float. The system may comprise a second interconnect that limits a range of movement of the first end of the first tether to within four meters of the first float. The system may comprise a third interconnect that limits a range of movement of the first end of the first tether to within seven meters of the first float.

The first float may have a maximum dimension of less than 30 cm and may have a buoyancy of less than 10 kilograms. The first float may be shaped so as to extend less than 20 cm or less than 10 cm below water when floating, unencumbered, on a water surface. Accordingly, any discussion in the present disclosure of a distance/range of movement relative to the first float may be understand as a distance/range of movement relative to a water surface on which the first float is floating. The first float may have substantially the shape of a sphere. The first float may comprise at least one (fin-like) securing portion (that extends from the sphere/a main portion of the float). The (respective) securing portion may comprise a hole, e.g. for receiving a carabiner, a portion of a tether, or other fastening means. The securing portion may comprise a plurality of ((substantially) "C"-shaped) hooks, e.g. a set of 4 to 9 or 5 to 7 hooks.

The first tether may comprise any of a rope, a (stainless steel) cable and on air hose (that supplies compressed air to a diver). (An elucidation of the term "any" is given in the closing paragraphs of this specification.) For example, the first tether may comprise a rope fastened to a cable. Similarly, the first tether may comprise a cable fastened to an air hose. Likewise, the first tether may comprise a first (section of) rope fastened to a cable that is fastened to a second (section of) rope. It will be understood that a multitude of other permutations is likewise possible.

The first interconnect may connect the first tether to the first float. Similarly, the second interconnect may connect the first tether to the first float. Likewise, the third interconnect may connect the first tether to the first float. For example, the first/second/third interconnect may comprise a loop knotted into a rope that constitutes (a portion of) the first tether. Similarly, the first/second/third interconnect may comprise a ring braided into a rope/cable that constitutes (a portion of) the first tether. The first float may comprise fastening means, e.g. a carabiner, releasably connectable to the loop/ring (of the first/second/third interconnect). Analogously, the first/second/third interconnect may comprise a fastener affixed to a rope/cable/air hose that constitutes (a portion of) the first tether.

The position at which the loop/ring/fastener (of the first/second/third interconnect) is knotted/braided/affixed to the rope/cable/air hose may define a respective maximum distance between the first float and a first end of the first tether/rope. The loop/ring/fastener (of the first interconnect) may be knotted/braided into the rope/affixed to the air hose/cable at a distance less than one meter from the first end of the first tether/rope. Similarly, the loop/ring/fastener (of the first interconnect) may be knotted/braided/affixed to the rope/cable/air hose at a distance less than 50 cm from the first end of the first tether/rope. As such, the first interconnect may limit a range of movement of the first end of the first tether to within 50 cm of the first float. The loop/ring/fastener (of the second interconnect) may be knotted/braided/affixed to the rope/cable/air hose at a distance less than four meters from the first end of the first tether/rope. Similarly, the loop/ring/fastener (of the second interconnect) may be knotted/braided/affixed to the rope/cable/air hose at a distance less than three meters from the first end of the first tether/rope. As such, the second interconnect may limit a range of movement of a first end of the first tether to within three meters of the first float. The loop/ring/fastener (of the third interconnect) may be knotted/braided/affixed to the rope/cable/air hose at a distance less than seven meters from the first end of the first tether/rope. Similarly, the loop/ring/fastener (of the third interconnect) may be knotted/braided/affixed to the rope/cable/air hose at a distance less than five meters from the first end of the first tether/rope. As such, the third interconnect may limit a range of movement of a first end of the first tether to within five meters of the first float. The first end of the first tether may be (releasably) fastened to (a dorsal or ventral region of) a harness and/or belt worn by a diver. (Hereinafter, the term "harness" will be used in lieu of "harness and/or belt" for the sake of conciseness.) As such, the underwater recreation system may comprise a (first) harness. The (first) harness may comprise a clasp for closing the (first) harness. The clasp may be provided at a dorsal or ventral region of the (first) harness.

As touched upon above, the securing portion (of the (first) float) may comprise a plurality of ((substantially) "C"-shaped) hooks, e.g. a set of 4 to 9 or 5 to 7 hooks. The first interconnect may comprise any of the plurality of hooks. Similarly, the second interconnect and/or the third interconnect may comprise any of the plurality of hooks. As such, any of the hooks may constitute (part of) the first, second and/or third interconnect. The first tether may comprise at least one marking specifying a (respective) region of the tether to be connected to the first float by means of (a subset of) the plurality of hooks to limit a range of movement of the first end of the first tether as specified supra, e.g. to within one meter, to within four meters or to within seven meters of the first float. The plurality of hooks may be configured and arranged so as to secure a tether (e.g. as described supra or hereinbelow) of the underwater recreation system to the float or to allow such a tether to be secured to the float. For example, the plurality of hooks may be configured and arranged such that the tether may be woven between the hooks. The hooks may be configured and arranged so as to prevent displacement (e.g. sliding) of the tether relative to the float even if the tether is tugged with a force of 100 N, a force of 200 N or a force of 300 N (relative to the float). The plurality of hooks may be situated on (e.g. extend from) a (substantially) planar surface of the float. The plurality of hooks may comprise a first set of hooks, e.g. a first set of hooks that open in a first direction, and a second set of hooks, e.g. a second set of hooks that open in a second direction opposite the first direction. The first set of hooks may comprise any of the plurality of hooks and the second set of hooks may comprise any other(s) of the plurality of hooks. The first set of hooks may be linearly arranged, e.g. arranged along a first line. Similarly, the second hooks may be linearly arranged, e.g. arranged along a second line that may be parallel to the first line. Any of the first set of hooks and/or any of the second set of hooks may open in a direction perpendicular to at least one of the first and second line. The first line may be distanced from the second line by a distance less than a diameter of a tether (e.g. as described supra or hereinbelow) of the underwater recreation system, e.g. a diameter of a tether secured to the float. Similarly, the first and second sets of hooks may be arranged such that a tether (e.g. as described supra or hereinbelow) of the underwater recreation system positioned between the first set of hooks and the second set of hooks is contacted on one side by the first set of hooks and contacted on an opposite side by the second set of hooks. The first and second sets of hooks may be arranged such that a tether (e.g. as described supra or hereinbelow) of the underwater recreation system positioned between the first set of hooks and the second set of hooks (invariably) traces a zigzag path. The first set of hooks may be arranged such that each hook of the first set of hooks faces a respective hook of the second set of hooks. Similarly, the second set of hooks may be arranged such that each hook of the second set of hooks faces a respective hook of the first set of hooks. Any (individual hooks) of the first set of hooks may face a (respective) midpoint between adjacent hooks of the second set of hooks. Similarly, any (individual hooks) of the second set of hooks may face a (respective) midpoint between adjacent hooks of the first set of hooks. As such, any hooks of the first set of hooks may be arranged in on offset fashion relative to hooks of the second set of hooks. In the context of the present paragraph, the verb "face" may be understood in the sense of "open in the direction of."

As touched upon above, the first float may comprise a plurality of securing portions, each having a hole. The first interconnect may comprise the plurality of securing portions. Similarly, the second interconnect and/or the third interconnect may comprise the plurality of securing portions. As such, the plurality of securing portions may constitute (part of) the first, second and/or third interconnect. The first tether may extend/be threaded through (each of) the (respective) holes of the plurality of securing portions. The first tether may comprise at least one marking specifying a (respective) region of the tether to be connected to the first float by means of the (respective) holes of the plurality of securing portions to limit a range of movement of the first end of the first tether as specified supra, e.g. to within one meter, to within four meters or to within seven meters of the first float. The underwater recreation system may comprise at least one tether retention device that, e.g. in a non-dilated state, prevents the first tether from sliding through any of the (respective) holes of the plurality of securing portions, for example by having a dimension larger than at least one of any of the (respective) holes of the plurality of securing portions. The tether retention device may comprise a (retaining) clip and/or a (retaining) clamp. (For the sake of better legibility, the term "retaining clip" will be used hereinafter to designate such a (retaining) clip/clamp.) The retaining clip may be dipped to (a portion of) the (first) tether intermediate the (respective) holes of the plurality of securing portions. As touched upon above, the retaining clip may have a dimension larger than at least one of any of the (respective) holes of the plurality of securing portions. The retaining clip may have on interior diameter, e.g. when the retaining clip is in a (natural) state without any external forces acting on the retaining dip, in the range of 70% to 100%, e.g. 90% to 100% or 95% to 99%, of on exterior diameter of the first tether. The retaining clip may snap onto on exterior diameter of the first tether. The retaining clip may extend around 50% to 80% of on outer circumference of the first tether. The retaining clip may have a (generally) C-shaped cross-section. Similarly, the retaining clip may extend 360° to 540°, e.g. 360° to 420°, around on outer circumference of the first tether. The retaining clip may comprise at least one tooth on an inner diameter of the retaining clip. The at least one tooth may inhibit a sliding of the retaining clip relative to the first tether, e.g. in a longitudinal direction of the first tether. The retaining clip may comprise at least one engagement portion on an outer diameter of the retaining clip, e.g. for receiving a tool for (elastically) dilating the retaining clip. Similarly, the retaining clip may comprise at least one (finger) tab on an outer diameter of the retaining dip, e.g. a (finger) tab at two respective ends of the retaining dip. The (finger) tabs may facilitate (a (manual) squeezing action for) dilating (an inner diameter) the retaining clip. The dilating of the retaining clip may facilitate placement of the retaining clip onto on outer diameter of the first tether and/or facilitate a sliding of the retaining dip, e.g. in a longitudinal direction of the first tether. The tether retention device/retaining clip may be designed/structured such that a tool is required to displace/remove the tether retention device/retaining clip relative to/from a tether. In other words, the tether retention device/retaining clip may be designed/structured such that the tether retention device/retaining clip cannot be manually removed from a tether and/or manually displaced on a tether.

The present disclosure teaches an underwater recreation system, comprising: a first float; a first tether connected to the first float; a first depth limiter connected to the first tether, an interconnection of the first depth limiter and the first tether limiting a range of movement of the first depth limiter to within one meter of the first float. The system may comprise a second depth limiter connected to the first tether, an interconnection of the second depth limiter and the first tether limiting a range of movement of the second depth limiter to within four meters of the first float. The system may comprise a third depth limiter connected to the first tether, an interconnection of the third depth limiter and the first tether limiting a range of movement of the third depth limiter to within seven meters of the first float. The first float may be a float as described heretofore. The first tether may be a tether as described heretofore.

Any of the first depth limiter, the second depth limiter and the third depth limiter may comprise a loop knotted into a rope that constitutes (a portion of) the first tether. Similarly, any of the first depth limiter, the second depth limiter and the third depth limiter may comprise a ring braided into a rope/cable that constitutes (a portion of) the first tether. Any of the first depth limiter, the second depth limiter and the third depth limiter may comprise a plurality of hooks, a plurality of securing portions and/or at least one tether retention device as described supra.

The position at which the loop/ring (of the first/second/third depth limiter) is knotted/braided into the rope/cable may define a respective maximum distance between the first float and first/second/third depth limiter. The loop/ring (of the first depth limiter) may be knotted/braided into the rope/cable at a distance less than one meter from the connection of the first tether/rope to the first float. Similarly, the loop/ring (of the first depth limiter) may be knotted/braided into the rope/cable at a distance less than 50 cm from the connection of the first tether/rope to the first float. As such, a range of movement of the first depth limiter may be limited to within 50 cm of the first float. The loop/ring (of the second depth limiter) may be knotted/braided into the rope/cable at a distance less than four meters from the connection of the first tether/rope to the first float. Similarly, the loop/ring (of the second depth limiter) may be knotted/braided into the rope/cable at a distance less than three meters from the connection of the first tether/rope to the first float. As such, a range of movement of the second depth limiter may be limited to within three meters of the first float. The loop/ring (of the third depth limiter) may be knotted/braided into the rope/cable at a distance less than seven meters from the connection of the first tether/rope to the first float. Similarly, the loop/ring (of the third depth limiter) may be knotted/braided into the rope/cable at a distance less than five meters from the connection of the first tether/rope to the first float. As such, a range of movement of the third depth limiter may be limited to within five meters of the first float. Any of the first depth limiter, the second depth limiter and the third depth limiter may be (releasably) fastened to (a dorsal or ventral region of) a harness worn by a diver. In other words, the harness may be connected to the first tether via any of the first depth limiter, the second depth limiter and the third depth limiter. As such, the underwater recreation system may comprise a (first) harness. The (first) harness may comprise a clasp for closing the (first) harness. The clasp may be provided at a dorsal or ventral region of the (first) harness.

The present disclosure teaches on underwater recreation system, comprising: a first float; a first harness; a first depth limiting system connectable to a dorsal or ventral region of the first harness that limits a range of movement of the first harness to within one meter of the first float. The system may comprise a second depth limiting system connectable to a dorsal or ventral region of the first harness that limits a range of movement of the first harness to within four meters of the first float. The system may comprise a third depth limiting system connectable to a dorsal or ventral region of the first harness that limits a range of movement of the first harness to within seven meters of the first float. The first float may be a float as described heretofore. The first harness may be a harness as described heretofore.

The first/second/third depth limiting system may comprise any of a rope, a (stainless steel) cable and on air hose (that supplies compressed air to a diver). It will be understood from the discussion above relating to the first tether that this description of the first/second/third depth limiting system covers a multitude of possible permutations. The rope/cable/air hose may comprise at least one attachment portion, e.g. a first attachment portion and a second attachment portion. For example, (any end of) the rope/cable may be formed into a loop or may be tied/braided/secured to a ring (to form the (first/second) attachment portion). Similarly, the rope/cable/air hose may have a fastener affixed to the rope/cable/air hose (to form the (first/second) attachment portion). The (first) attachment portion, e.g. a respective loop/ring/fastener, may be (releasably) fastened to a dorsal or ventral region of the first harness, for example directly or via a carabiner. The (second) attachment portion, e.g. a respective loop/ring/fastener, may be (releasably) fastened to the first float, for example directly or via a carabiner.

A distance between the first and second attachment portion (of the respect depth limiting system) may define a (maximum) range of movement of the harness relative to the first float. The first depth limiting system may limit a range of movement of the first harness to within one meter or to within 50 cm of the first float. The second depth limiting system may limit a range of movement of the first harness to within four meters or to within three meters of the first float. The third depth limiting system may limit a range of movement of the first harness to within seven meters or to within five meters of the first float.

As touched upon above, the first/second/third depth limiting system may comprise any of a rope, a (stainless steel) cable and on air hose (that supplies compressed air to a diver). Similarly, the first/second/third depth limiting system may comprise (a portion of) the first tether, a plurality of hooks, a plurality of securing portions and/or at least one tether retention device as described supra.

The present disclosure teaches on underwater recreation system, comprising: a first float; a first harness; and an adjustable depth limiting system that connects said first float to a dorsal or ventral region of said first harness and limits a range of movement of said first harness relative to said first float. The first float may be a float as described heretofore. The first harness may be a harness as described heretofore.

The adjustable depth limiting system may comprise any of a rope, a (stainless steel) cable and an air hose (that supplies compressed air to a diver). It will be understood from the discussion above relating to the first tether that this description of the adjustable depth limiting system covers a multitude of possible permutations. The rope/cable/air hose may comprise at least one attachment portion, e.g. a first attachment portion and a second attachment portion. For example, (an end of) the rope/cable may be formed into a loop or may be tied/braided/secured to a ring (to form the (first/second) attachment portion). Similarly, the rope/cable/air hose may have a fastener (releasably) affixed to the rope/cable/air hose (to form the (first/second) attachment portion). The (first) attachment portion, e.g. a respective loop/ring/fastener, may be (releasably) fastened to a dorsal or ventral region of the first harness, for example directly or via a carabiner. The (second) attachment portion, e.g. a respective loop/ring/fastener, may be (releasably) fastened to the first float, for example directly or via a carabiner.

A distance between the first and second attachment portion (of the adjustable depth limiting system) may define a (maximum) range of movement of the harness relative to the first float. Accordingly, the distance between the first and second attachment portion (of the adjustable depth limiting system) may be adjustable, e.g. by releasing a fastener affixed to the rope/cable/air hose (at a first position) and re-affixing the fastener to the rope/cable/air hose at a different position (than the first position).

In any of the underwater recreation systems described hereinabove, any ring/fastener affixed to the rope/cable/air hose may be affixed strongly enough to prevent sliding of the rope/cable/air hose relative to the ring/fastener even if the rope/cable/air hose is tugged with a force of 100 N, a force of 200 N or a force of 300 N (relative to the ring/fastener).

As touched upon above, the adjustable depth limiting system may comprise any of a rope, a (stainless steel) cable and on air hose (that supplies compressed air to a diver). Similarly, the adjustable depth limiting system may comprise (a portion of) the first tether, a plurality of hooks, a plurality of securing portions and/or at least one tether retention device as described supra.

Any of the underwater recreation systems described hereinabove may comprise a second harness and may comprise a first range limitation system that limits a range of movement of the first harness relative to the second harness. The second harness may be a harness as described heretofore. The second harness may be configured to be worn by a diver. The first range limitation system may comprise any of a rope, a (stainless steel) cable and an air hose (that supplies compressed air to a diver). It will be understood from the discussion above relating to the first tether that this description of the first range limitation system covers a multitude of possible permutations. The (rope/cable/air hose of the) first range limitation system may directly interconnect the first harness and the second harness. Similarly, (the rope/cable/air hose of) the first range limitation system may interconnect the first harness and the second harness via the first float and/or a second float. The first range limitation system may limit a range of movement of the first harness to within 10 meters, to within seven meters, to within five meters or to within three meters of the second harness.

Any of the underwater recreation systems described hereinabove may comprise a second float and may comprise a second range limitation system that limits a range of movement of the first float relative to the second float. The second float may be a float as described heretofore. The second float may comprise at least one component selected from the group consisting of a flag mount, a diver awareness flag, a(n electrically powered) propulsion system, an (electrically powered) air compressor, at least one compressed air tank, an (electrically powered) anchor system, a propulsion control system, an anchor control system and a tow bar.

The second range limitation system may comprise any of a rope, a (stainless steel) cable and an air hose (that supplies compressed air to a diver). It will be understood from the discussion above relating to the first tether that this description of the second range limitation system covers a multitude of possible permutations. The (rope/cable/air hose of the) second range limitation system may directly interconnect the first float and the second float. The second range limitation system may limit a range of movement of the first float to within 10 meters, to within seven meters, to within five meters or to within three meters of the second float.

As touched upon above, the first/second range limitation system may comprise any of a rope, a (stainless steel) cable and on air hose (that supplies compressed air to a diver). Similarly, the first/second range limitation system may comprise (a portion of) the first tether, a plurality of hooks, a plurality of securing portions and/or at least one tether retention device as described supra.

The first range limitation system and the second range limitation system may share at least a portion of a tether. In other words, the first range limitation system may comprise (at least a portion of) a rope, a (stainless steel) cable and/or on air hose (that supplies compressed air to a diver), (at least a portion of) which rope, and/or air hose constitutes on element of/is comprised by the second range limitation system.

For example, on underwater recreation system as described hereinabove may comprise a first air hose for supplying compressed air to a first diver, which first air hose extends from a second float (that supports a compressor and/or at least one compressed air tank that supplies the compressed air) to the first diver via a first float. The first air hose may be fastened to the first and second floats and thus limit the range of movement of the first float relative to the second float. As such, a portion of the first air hose may constitute a second range limitation system as described above. At the some time, the first air hose may be fastened to a first harness worn by the first diver, the first air hose acting as (part of) a tether/depth limiting system as described hereinabove (to limit a depth/distance/range of movement of the first diver relative to the first float). Meanwhile, the underwater recreation system may comprise a second air hose that extends from the second float to a second diver. The second air hose may be fastened to a second harness worn by the second diver and may be fastened to the first air hose between the first and second floats. By virtue of their interconnection, the first and second air hoses may cooperatively limit a range of movement of the first harness relative to the second harness. As such, the first air hose may constitute (part of) a first range limitation system as described above.

More generally, as exemplified by the preceding example, any of the aforementioned range limitation systems, depth limiting system and tethers may comprise (at least a portion of) a rope, a (stainless steel) cable and/or on air hose (that supplies compressed air to a diver), (at least a portion of) which rope, and/or air hose constitutes on element of/is comprised by any other(s) of the aforementioned range limitation systems, depth limiting system and tethers.

As touched upon above, the first range limitation system may be fastened to the second range limitation system, or vice-versa. Accordingly, the first range limitation system may comprise a fastener for fastening the first range limitation system to the second range limitation system. Similarly, the second range limitation system may comprise a fastener for fastening the second range limitation system to the first range limitation system. The fastener may comprise any of a loop, ring or carabiner secured to (a tether of) the first/second range limitation system, e.g. by tying, braiding or by means of clamping hardware. The fastener may be adjustable secured to (a tether of) the first/second range limitation system. The fastener may be strongly enough secured to (a tether of) the first/second range limitation system to prevent sliding of the fastener relative to (the tether of) the first/second range limitation system even if (the tether of) the first/second range limitation system is tugged with a force of 100 N, a force of 200 N or a force of 300 N (relative to the fastener).

The first range limitation system may be fastened to the second range limitation system at/via a third float. The third float may be a float as described heretofore.

Any of the underwater recreation systems described hereinabove may comprise a propulsion system and/or an anchor system. For example, as already touched upon above, the second float may comprise a(n electrically powered) propulsion system and/or an anchor system. Similarly, any of the underwater recreation systems described hereinabove may comprise a control system, e.g. for controlling at least one of the propulsion system and the anchor system. The control system may be configured to be operable from underwater by a diver.

Any of the underwater recreation systems described hereinabove may comprise a spring-loaded reel mechanism for reeling in an anchor line of the anchor system. For example, the control system may comprise the spring-loaded reel mechanism. The spring-loaded reel mechanism may be configured such that a(n underwater) weight of on anchor of the anchor system is sufficient to draw out on anchor line that connects the anchor to the spring-loaded reel mechanism. Similarly, the spring-loaded reel mechanism may be configured such that the spring-loaded reel mechanism recoils the anchor line when the anchor line is relieved of the (underwater) weight of the anchor, e.g. by a diver (grasping the anchor line and) lifting the anchor.

Any of the underwater recreation systems described hereinabove may comprise a tow bar. For example, the (first/second/third) float may comprise a tow bar. The tow bar may be connected to the (first/second/third) float, e.g. by a tow line that may comprise a rope and/or a (stainless steel) cable. The tow bar may comprise a grip region, e.g. for receiving at least one, i.e. one or both, hand(s) of each of one, two or more (submerged) divers. The tow bar may comprise a control system as described above. The tow bar may comprise a spring-loaded reel mechanism as described above.

As already touched upon above, the present disclosure teaches an underwater recreation system, comprising: a float; at least one of a propulsion system for propelling the float and an anchor system for anchoring the float; and a control system for controlling at least one of the propulsion system and the anchor system, the control system being operable from underwater by a diver. The float may be a float as described heretofore. The propulsion system may be a propulsion system as described heretofore. The anchor system may be an anchor system as described heretofore, and the control system may be a control system as described heretofore.

The present disclosure furthermore teaches a method of diving instruction. The method may comprise limiting a diving depth of a (first) diver to a first depth, e.g. by tethering the (first) diver to a (first) float. Similarly, the method may comprise limiting a diving depth of a (second) diver to a second depth, e.g. by tethering the (second) diver to a float, e.g. to the first float or a second float. Furthermore, the method may comprise limiting a diving depth of a (third) diver to a third depth, e.g. by tethering the (third) diver to a float, e.g. to the first float, the second float or a third float. The (first/second/third) float may be a float as described heretofore. The second depth may be deeper than the first depth. The third depth may be deeper than the second depth. The second diver may be of higher diving proficiency than the first diver. The third diver may be of higher diving proficiency than the second diver. For example, the second diver may have diving proficiency suitable for diving deeper than the first depth. In contrast, the first diver may lock diving proficiency suitable for diving deeper than the first depth. Similarly, the third diver may have diving proficiency suitable for diving deeper than the second depth. In contrast, the second diver may lack diving proficiency suitable for diving deeper than the second depth. The (first/second/third) diver's diving proficiency may be a diving proficiency documented by certification (issued to the diver), e.g. by an international diving organization).

The method may comprise determining, prior to limiting a diving depth of a (first) diver to the first depth, a proficiency of the (first) diver to swim. The method may comprise determining, prior to limiting the diving depth of the (second) diver to the second depth, a proficiency of said second diver to remove and/or replace a regulator/mouthpiece underwater. The method may comprise determining, prior to limiting the diving depth of the (third) diver to the third depth, a proficiency of the (third) diver to equalize ear pressure underwater and/or to ascend at a controlled rate. The controlled rate may be a(n ascent) rate in the range of 6 to 18 meters per minute, e.g. in the range of 8 to 12 meters per minute.

The first depth may be a depth of less than one meter or less than 50 cm. The second depth may be a depth of less than four meters or less than three meters. The third depth may be a depth of less than seven meters or less than five meters. The (first/second/third) depth may be measured relative to a water surface or relative to a float floating on a water surface, e.g. relative to the first/second/third float described supra.

The method may comprise securing a tether to a dorsal or ventral region of a harness worn by the (first/second/third) diver. The method may comprise securing the tether to a float, e.g. to the first/second/third float described supra. The tether may be a tether as described heretofore. The harness may be a harness as described heretofore. The limiting a diving depth may be effected using the tether. For example, as discussed in detail heretofore, the tether, e.g. together with on interconnect and/or as (part of) a depth limiting system, may limit a distance between the harness and a float.

The method may comprise limiting a distance between the (first/second/third) diver and another diver. The limiting may be effected/may comprise tethering the (first/second/third) diver to the other diver, e.g. via a float, for example via the first/second/third float described supra. The method may comprise tethering the (first/second/third) diver to the other diver using on air hose that supplies compressed air to the other diver and an air hose that supplies compressed air to the (first/second/third) diver. The method may comprise limiting a distance between said the other diver and a float, e.g. the first/second/third float described supra, by tethering the other diver to the (first/second/third) float via the (first/second/third) diver.

The various embodiments of the present disclosure having been described above in general terms, the embodiments shown in the Figures will now be elucidated. The nomenclature used in the following description of the figures may be understood in the sense used in the preceding description. Nonetheless, the nomenclature used in the following description of the figures may be understood in the sense different from that used in the preceding description. In other words, the preceding description is not to be construed as limiting the following description of the figures. The following description of the figures may be understood independently of the preceding description or as complementing the preceding description.

The figures show various embodiments of the teachings of the present disclosure, including:

- A depth control system where a beginning diver is tethered to a surface flotation limiter through a variable length connection that cannot be changed by the restricted user, i.e. the beginning diver, while they are using the device. In this way, even when the beginner diver is in deeper open waters, the maximum depth can be limited to specific maximum depths.
- A range control system where a beginning diver is tethered to a more advanced diver through a variable length connection that cannot be changed by the restricted user, i.e. the beginning diver, while they are using the device. In this way, their depth and distance can be limited relative to the depth and position of the more advanced diver.
- A surface supplied air system, with separate hoses for the beginner and advanced diver, where a range control element can be variably positioned between the hoses to limit the range between them.
- A surface supplied air system, with a separate hose for the beginner diver, where a floating depth control element can be variably positioned on the beginner diver's hose to limit the maximum depth they can go.
- A surface supplied air system, with separate hoses for the beginner and advanced diver, where a range control element can be variably positioned between the hoses to limit the range between them, and a floating depth control element can be variably positioned on the beginner diver's hose to limit the maximum depth they can go.

FIG. 1A shows an embodiment of an underwater recreation system in accordance with the present disclosure, e.g. as described above. In particular, FIG. 1A shows on embodiment of an apparatus with a surface supplied air system, and with separate hoses for a beginner and advanced diver, where a range control element can be variably positioned between the hoses to limit the range between them, and a small floating depth control element can be variably positioned on the beginner diver's hose to limit the maximum depth they can go.

The embodiment of FIG. 1A comprises a surface supplied air system (11) based on an electric pump, with a combined intake/dive flag (10), supported on a flotation device (12). The main hose (31) provides breathable air to a main diver (41), and a secondary hose (30) provides breathable air to a beginner diver (40). In a manner typical to the standard art of surface supplied air systems, the hoses are attached to the respective divers through a harness or belt, so that any possible tension on the mouthpiece of the hose is avoided. A floating depth limitation device (21) is variably attached to the secondary hose (30). It can be adjusted to different distances away from the beginner diver (40), ranging from 0 m to 5 m, and locked into place. It has sufficient buoyancy that it cannot be pulled underwater by the beginner diver; preferably in the range of 2 to 10 kg of buoyancy. In this way the maximum depth of the beginner diver (40) is limited to the distance between the depth limitation device (21) and the beginner diver (40). A range limitation device (20) is variably attached to both the secondary hose (30) and the main hose (31). In the figure, it is positioned behind the depth limitation device (21), however, it can also be positioned before it. It has no significant buoyancy, and can also be non-buoyant, provided it is not so heavy to be cumbersome; preferably in the range of −0.5 to +0.5 kg of buoyancy. In this way, the maximum range, laterally, upwards, or downwards, that the beginner diver (40) can move away from the main diver (41) is limited to the sum of the distance between the range limitation device (20) and the beginner diver (40) plus the distance between the range limitation device (20) and the main diver (41). The two distances need not be equal.

Figure 1B:
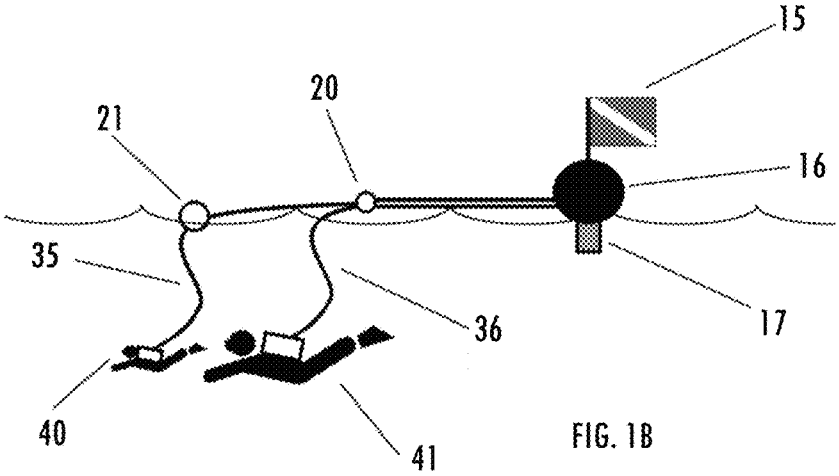
FIG. 1B shows another embodiment of an underwater recreation system in accordance with the present disclosure.

FIG. 1B shows another embodiment of on underwater recreation system in accordance with the present disclosure, e.g. as described above. In particular, FIG. 1B shows on embodiment of on apparatus with SCUBA divers using a main surface diver awareness and safety float, and with separate tethers for the beginner and advanced diver, where a range control element can be variably positioned between the tethers to limit the range between them, and a small floating depth control element can be variably positioned on the beginner diver's tether to limit the maximum depth they can go.

The embodiment of FIG. 1B comprises a main safety float (16) that supports a diver awareness flag (15). It may have an additional ballast weight (17) to ensure greater stability and maintain the flag in on upright position. Alternatively the safety float (16) may be sized significantly larger, and designed in more stable shape, like a raft, and would have the additional benefit that a user could rest on it or store equipment. It has a tether (35) leading to the beginner diver (40) and another tether (36) leading to the advanced diver (41). The beginner diver's tether is attached to the back of their BCD or tank in such a way that it does not hinder them, and they cannot detach it. In the depicted embodiment, the tether is a rope, but it could also be constructed from alternate materials. A floating depth limitation device (21) is variably attached to the beginner diver's tether (35). A range limitation device (20) is variably attached to both the tethers (35) and (36). They may function in the some way as in any of the previously described embodiments.

Figure 1C:
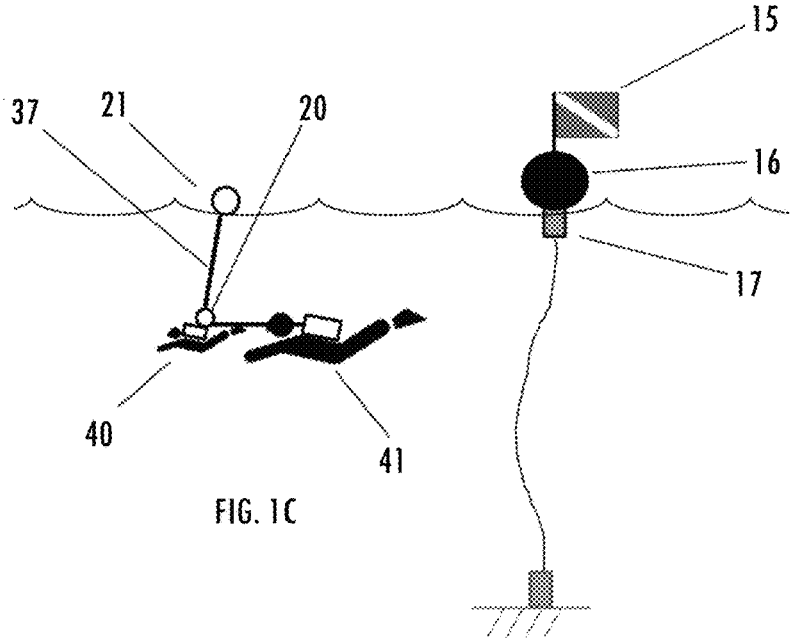
FIG. 1C shows another embodiment of an underwater recreation system in accordance with the present disclosure.

FIG. 1C shows another embodiment of an underwater recreation system in accordance with the present disclosure, e.g. as described above. In particular, FIG. 1C shows on embodiment of an apparatus with SCUBA divers, with a shared tether (37) rather than separate tethers to the main diver awareness and safety float, where a range control element can be variably positioned between the beginner and advanced diver to limit the range between them, and a small floating depth control element can be variably positioned on the beginner diver to limit the maximum depth they can go.

The embodiments described above, e.g. as shown in FIGS. 1A, 1B, and 1C are not to be considered limiting. A variety of alternate designs or readily available components may be considered as appropriate for use. In particular, the air supply system or float may first have an initial section of combined hose or tether before splitting into the separate hoses or tethers for the beginner diver and advanced diver. An intermediate air reservoir or manifold may also be used. Instead of a compressor, the air supply may also come from a compressed air tank, like the kind commonly used for scuba diving. The system may provide for more than two divers, and the additional hoses could be intended for further advanced divers or beginner divers. For each beginner diver, separate depth limitation and range control devices can be used so that each individual diver can be individually limited and utilize the system to the maximum of their capability. The system could also provide for just a single hose or tether, in which case, only the separate depth limitation device is used.

The embodiments described above, e.g. as shown in FIG. 1A can be further enhanced by providing a means for propulsion and/or a means for temporarily anchoring the apparatus. In this manner, the divers may be towed to their desired dive location and explore the proximate area around the apparatus without having to tow the entire device.

As touched upon above, the present disclosure furthermore teaches a control system for a surface supplied air system. At least one user interface of the control system may be (positionable) underwater and may be operable by a user to release or retrieve on anchor while remaining underwater. The control system may comprise a propulsion system. A(n underwater) user interface of the control system my be variably fixed for operation at a variety of different depths underwater. The control system may comprise means for a main user, e.g. on (experienced) diver, and for additional divers on to while being towed. For example, the control system may comprise a user interface that can be variably fixed at depths ranging 0.5 m to 5.0 m underwater, has handles to tow multiple divers, and can be operated by the main diver to release or retrieve an anchor and control the speed and direction of the propulsion system.

Figure 2A:
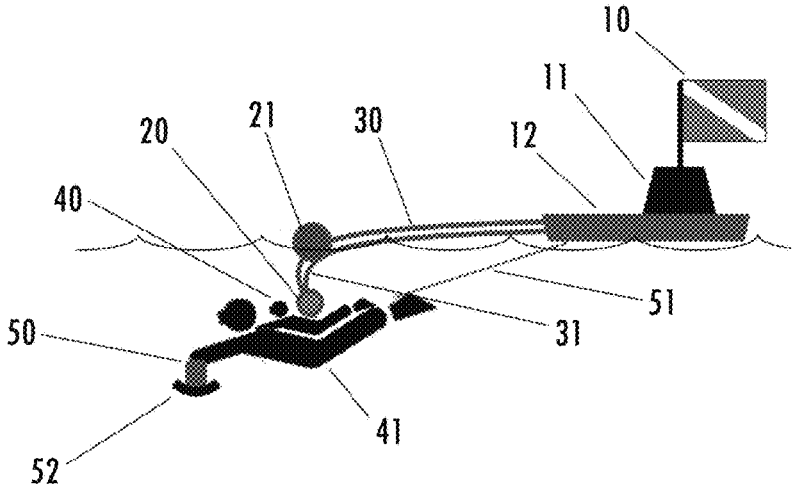
FIG. 2A shows another embodiment of an underwater recreation system in accordance with the present disclosure.

FIG. 2A shows another embodiment of on underwater recreation system in accordance with the present disclosure, e.g. as described above. In particular, FIG. 2A shows a surface supplied air system with a control system, e.g. as described above, where the advanced diver (41) can observe and/or control different aspects of the surface supplied air system (11) and/or flotation device (12) while remaining underwater through a control user interface (50). The control user interface (50) may be either mechanical or electrical, and may be attached to the surface supplied air system (11) or flotation device (12) through a mechanical or electrical connecting element (51). The connecting element (51) may be either flexible or rigid.

In the embodiment shown in FIG. 2A, the connecting element (51) may be flexible, and the control user interface (50) may be mechanical and allow the anchor (52) of the flotation device (12) to be mechanically released and retrieved. The control user interface may comprise extended handles such that both the advanced diver (41) and the beginner diver (40) can hold on to it. In this manner, the advanced diver can tow both the float and the beginner diver at the some time, while remaining underwater and scouting for interesting spots underwater to explore further. When they see something interesting, the advanced diver can release the anchor (52) and fix the flotation device (12) without having to surface. Subsequently, the advanced diver and the beginner diver can explore the area defined by the radius of the maximum length of their hoses and the position of the depth limiting device and range limiting device.

Figure 2B:
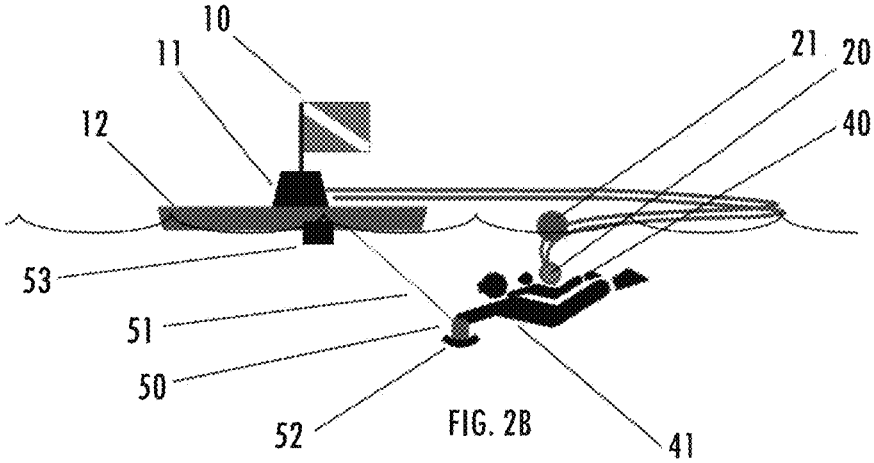
FIG. 2B shows another embodiment of an underwater recreation system in accordance with the present disclosure.

FIG. 2B shows another embodiment of on underwater recreation system in accordance with the present disclosure, e.g. as described above. In particular, FIG. 2B shows a control system, e.g. as described above. In the depicted embodiment, the connecting element (51) may be flexible, and the control user interface (50) may be both electrical and mechanical. It may control the anchor (12) mechanically, e.g. as in the embodiment shown in FIG. 2A, and it may also electrically control a propulsion system (53). In the depicted embodiment, the propulsion system may comprise/consist of a pair of electric propulsion motors on lateral sides of the flotation device (12). The speed of each motor may be independently controlled, e.g. by two separate trigger switches on the control user interface. In this manner, both speed and direction can be electrically controlled from the control user interface (50). However, other propulsion systems as known in the art may be employed.

Figure 2C:
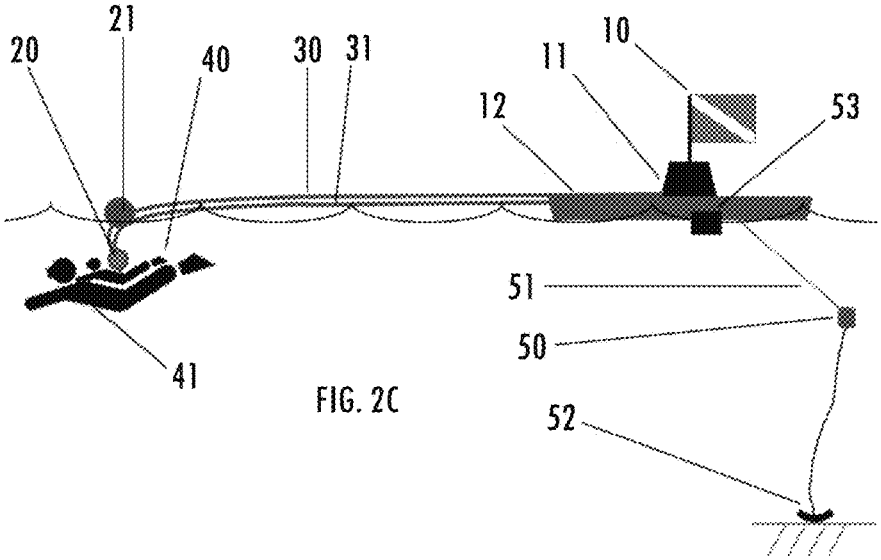
FIG. 2C shows the embodiment of FIG. 2B in another state.

FIG. 2C shows the embodiment of FIG. 2B in another state, in particular with the anchor released.

Figure 3A:
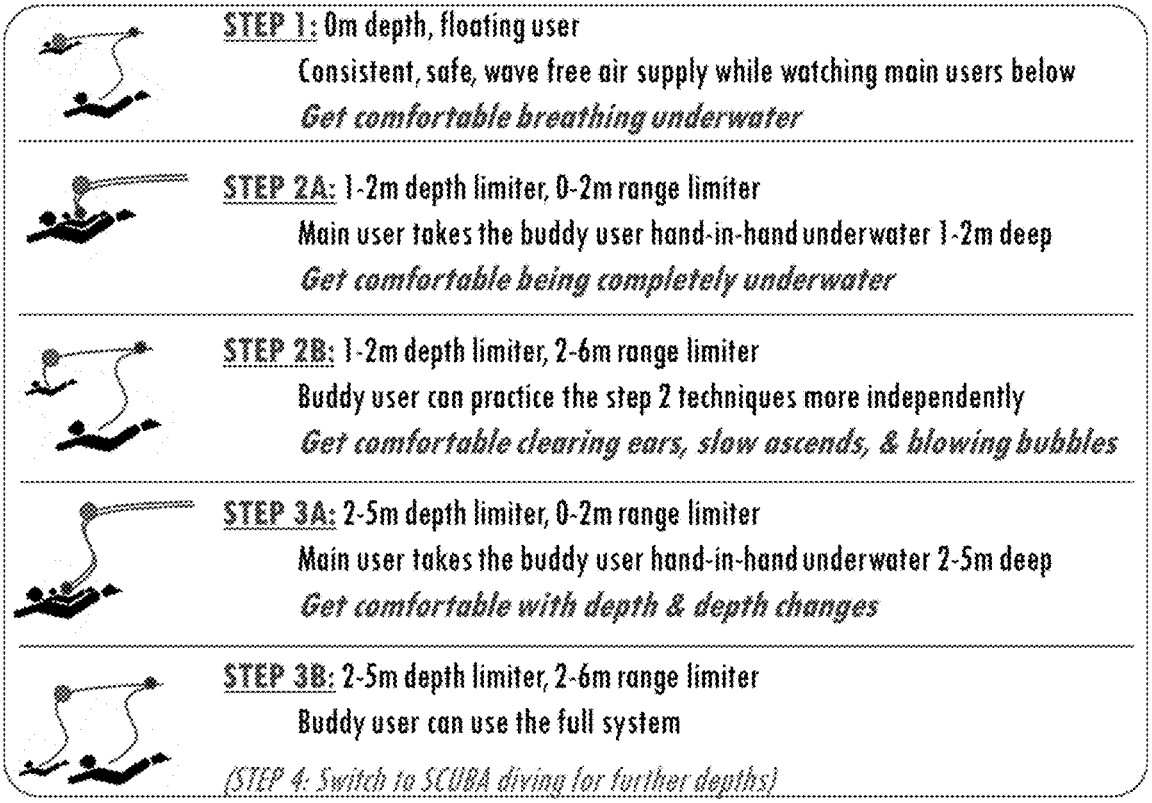
FIG. 3A schematically depicts a method of diving instruction in accordance with the present disclosure.

FIG. 3A schematically depicts a method of diving instruction in accordance with the present disclosure, e.g. as described above. The depicted embodiment comprises three specific depth steps. Within each step, the depth limitations can be further broken down into sub-steps.

Figure 3B:
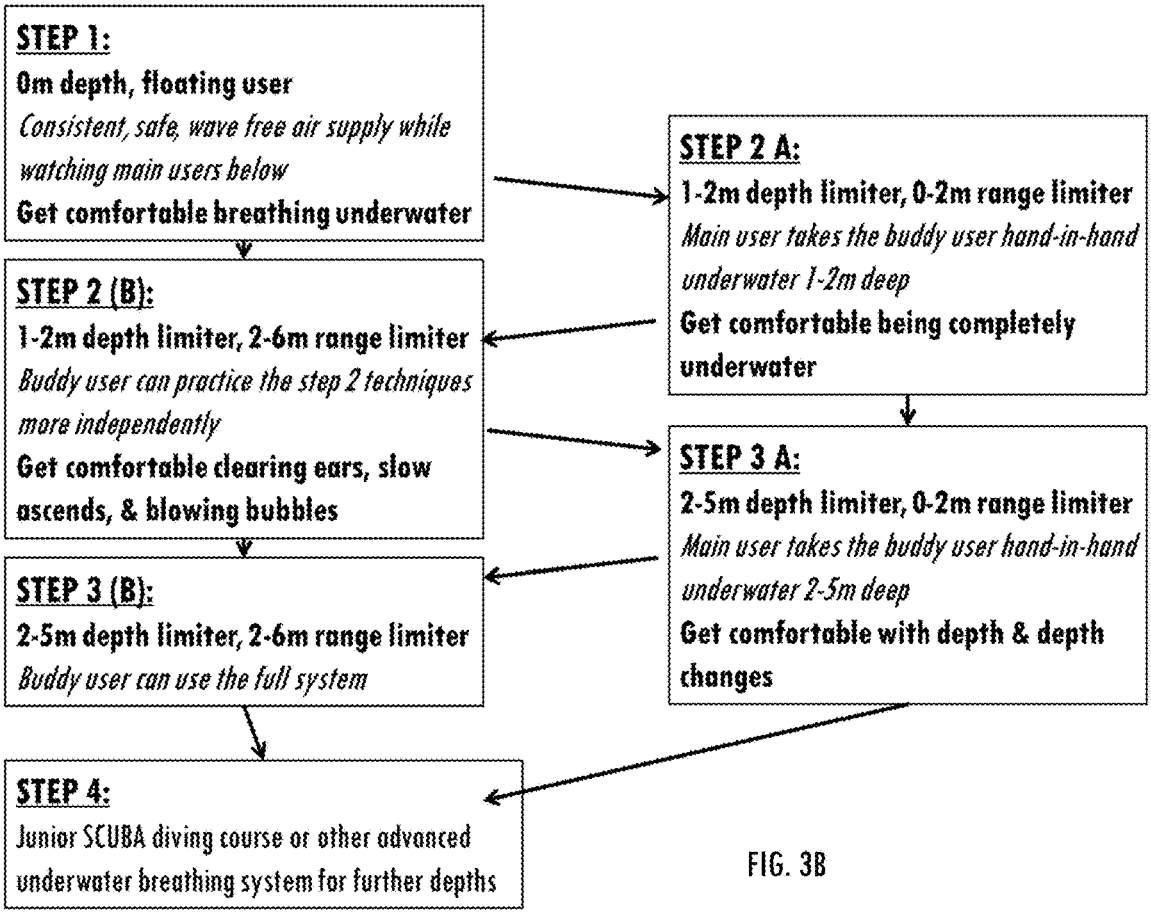
FIG. 3B schematically depicts, as a flow chart, embodiments of a method of diving instruction in accordance with the present disclosure.

The particular embodiment shown in FIG. 3A should not be considered limiting. A variety of alternate definitions and descriptions for the steps and sub-steps may be considered. The flotation of the learning diver in the first step may be further enhanced by the use of a flotation vest. The images use the surface supplied air embodiment of the apparatus, but the some method could be accomplished with a variety of other embodiments of the apparatus. Other depth and range combinations may be used with a similar effect. Depth and range limitations may be broken down further to create additional intermediary steps. Also, the experiences and SCUBA techniques that are taught at each step or sub-step may be changed as appropriate. Further, one does not need to proceed through the sub-steps linearly, allowing for a variety of different paths. This is shown more clearly in the flow diagram of FIG. 3B. FIG. 3B schematically depicts, as a flow chart, embodiments of a method of diving instruction in accordance with the present disclosure, e.g. as described above.

Figure 4A:
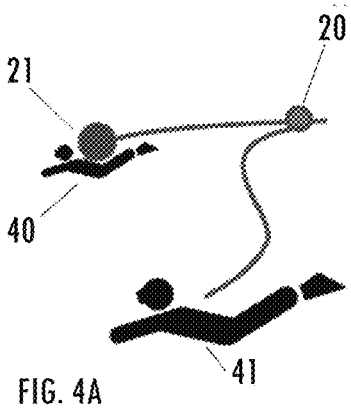
FIG. 4A depicts on exemplary method of diving instruction in accordance with step 1 of FIG. 3A or 3B.

FIG. 4A depicts an exemplary method of diving instruction in accordance with step 1 of FIG. 3A or 3B. In the first step, the learning diver (40) may be limited to the surface of the water. This may be effected by positioning the depth limitation device (21) within 0.5 m from the learning diver (40). It may be attached directly at the harness or belt attachment point of the hose. The flotation of the learning diver in the first step may be further enhanced by the use of a flotation vest. In this case, the depth limiting device may be left out.

In the first step, the advanced diver (41) may accompany the beginner diver (40), and the maximum distance between them may be limited by the range limitation device (20).

Though not specifically shown, sub-steps to the first step can be defined by incrementally increasing distances of the range limitation device (20) as the beginner diver becomes more comfortable. Alternatively, the range limitation device (20) may be left out. In this step, the beginner diver can practice inhaling underwater, exhaling underwater, keeping the regulator properly in their mouth, removing and replacing the regulator underwater, etc.

Figure 4B:
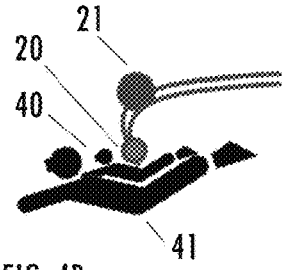
FIG. 4B depicts on exemplary method of diving instruction in accordance with step 2 of FIG. 3A or 3B.

FIG. 4B depicts an exemplary method of diving instruction in accordance with step 2 of FIG. 3A or 3B. In this step, the learning diver (40) is limited to a maximum depth between 0.5 m and 4.0 m, preferably 1.5 m or 2.0 m. This may be effected by positioning the depth limitation device (21) within 1.5 m or 2.0 m from the learning diver (40). The figure further shows the initial placement of the range limitation device (20), positioned and fixed before the depth limitation device (21), preferably at a distance of about 0.5 m to 1.0 m from both divers. Alternatively, the range limitation device (20) may be left out. In such a case, the divers may go hand-in-hand or arm-in arm. This creates a sub-step where the advance diver closely accompanies the beginner diver when they initially go down to the maximum depth of step 2, and can provide assistance or comfort when needed.

Figure 4C:
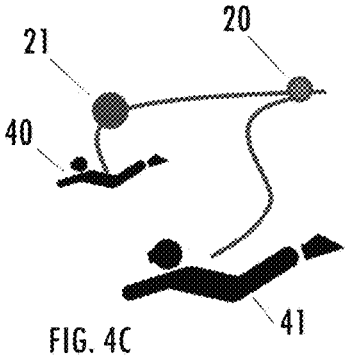
FIG. 4C depicts on exemplary method of diving instruction in accordance with a sub-step of step 2 of FIG. 3A or 3B.
Figure 4D:
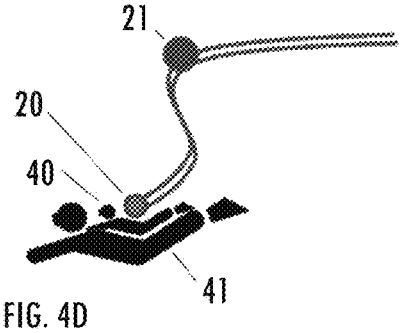
FIG. 4D depicts on exemplary method of diving instruction in accordance with step 3 of FIG. 3A or 3B.

FIG. 4C depicts an exemplary method of diving instruction in accordance with a (subsequent) sub-step of step 2 of FIG. 3A or 3B. Specifically, it shows a (subsequent) sub-step of step 2, where the maximum depth is still limited in the range of 0.5 m to 4.0 m, e.g. in the range of 1.5 m to 2.0 m, but now the range limitation device (20) is positioned and fixed after the depth limitation device (21) or left off completely. The range limitation device (20) may be positioned in the range of 2.0 m-6.0 m from both divers. This creates a sub-step where the beginner diver has more independence to practice on his own, while the advanced diver can also dive more independently. In this step, the beginner diver can learn and practice basic diving techniques such as dive signals, submerging, equalizing their ears, clearing their mask, slow ascends, exhaling or blowing bubbles while ascending, etc.

FIG. 40 depicts on exemplary method of diving instruction in accordance with (an initial sub-step of) step 3 of FIG. 3A or 3B. In this (sub-)step, the learning diver (40) may be limited to a maximum depth between 2.5 m and 7.0 m, e.g. 4.0 m or 5.0 m. This may be effected by positioning the depth limitation device (21) within 4.0 m or 5.0 m from the learning diver (40). The figure further shows the initial placement of the range limitation device (20), positioned and fixed before the depth limitation device (21), e.g. at a distance of about 0.5 m to 1.0 m from both divers. The range limitation device (20) can also be left out. In such a case, the divers may go hand-in-hand or arm-in arm. This creates a sub-step where the advance diver closely accompanies the beginner diver when they initially go down to the maximum depth of step 3, and can provide assistance or comfort when needed. This (sub-)step may comprise slowing on ascent of the beginning diver by the weight and resistance of the advanced diver.

Figure 4E:
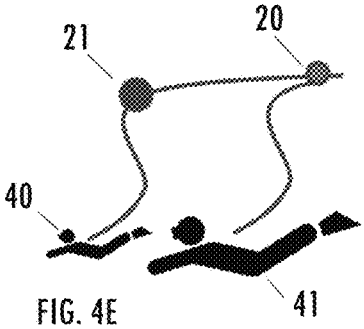
FIG. 4E depicts on exemplary method of diving instruction in accordance with a sub-step of step 3 of FIG. 3A or 3B.

FIG. 4E depicts on exemplary method of diving instruction in accordance with a (subsequent) sub-step of step 3 of FIG. 3A or 3B. Specifically, it shows a (subsequent) sub-step of step 3, where the maximum depth is still limited in the range of 2.5 m to 7.0 m, but now the range limitation device (20) is positioned and fixed after the depth limitation device (21) or left off completely. The range limitation device (20) may be positioned in the range of 3.0 m-10.0 m from both divers, e.g. 6.0 m.

Figure 5A:
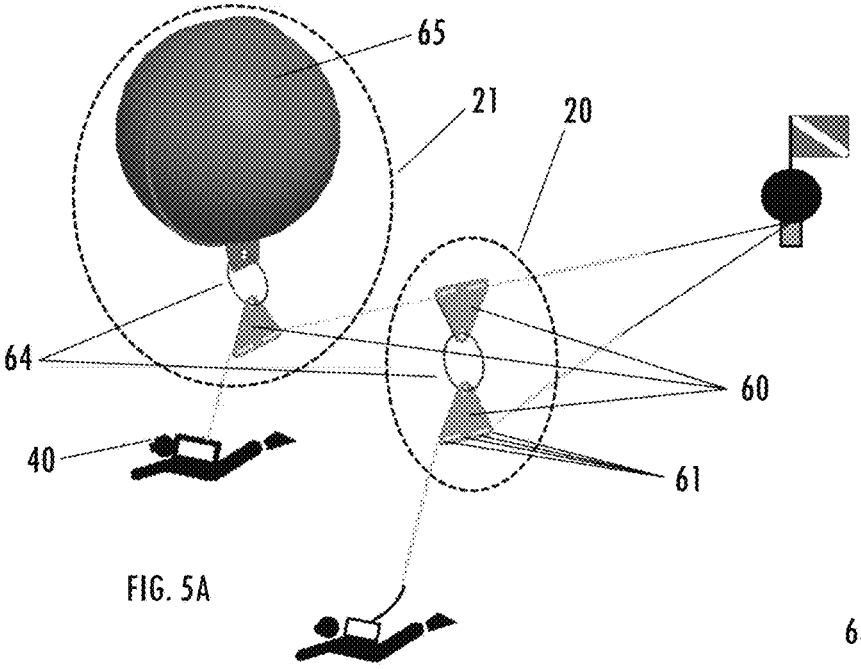
FIG. 5A shows another embodiment of an underwater recreation system in accordance with the present disclosure.

FIG. 5A shows another embodiment of on underwater recreation system in accordance with the present disclosure, e.g. as described above. Inter alia, FIG. 5A shows a detail view of an embodiment of the range limitation device (20) and floating depth limitation device (21), which embodiment is designed to work with rope tethers, e.g. with rope tethers of the embodiments shown in FIG. 1B and FIG. 1C.

The depicted embodiment uses variable attachment links (60) to attach to the rope tether in such a way that it can be varied, but also easily locked by pulling the rope tout. Each variable attachment link (60) has a plurality of holes (61) through which the rope tether is woven. The floating element (65) of the depth limitation device (21) can be constructed from a variety of materials, solid or inflatable, as long as it is of conveniently small size so as to not hinder the beginner diver (40). For example, the floating element (65) may be inflatable, with a volume in the range of about 2 L to 6 L or 2 L to 10 L of air for buoyancy. A variety of commonly available rings, clips, shackles, carabiners, etc. can be used as connecting rings (64).

Figure 5B:
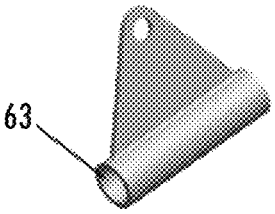
FIG. 5B shows on embodiment of a component of on underwater recreation system in accordance with the present disclosure.

FIG. 5B shows an embodiment of a component of an underwater recreation system in accordance with the present disclosure, e.g. as described above. Specifically, FIG. 5B shows a detail view of another embodiment of a variable attachment link, e.g. as generally described above. This embodiment is designed to work with air hoses, e.g. with the air hoses of the embodiment shown in FIG. 1A. It has a tubular feature (63) with on internal diameter slightly larger than the outer diameter of the air hose and through which the air hose is led. The exact clearance between them depends on the flexibility and friction of the air hose and should be such that the attachment's position on the hose can be varied when the hose is not pressurized, and is locked when the hose is pressurized. Constrictions or other geometric features inside the tubular feature can also be used to assist in locking the hose when pressurized. The tubular feature can also be formed as two halves, with a (thumb) screw or other fastener to fix them together and clamp down on the hose.

Alternatively, a plurality of attachment links may be permanently fixed to the hose or tether at particularly defined distances away from the diver attachment points, for instance, every 0.5 m. In this case, the connecting ring (64) becomes the variable means of attachment of the depth limitation device (21) and range limitation device (20), and allows distance adjustment and function in the way described for previous embodiments.

FIG. 6 shows on embodiment of a component of on underwater recreation system in accordance with the present disclosure, e.g. as described above. Specifically, FIG. 6 shows on embodiment of the control user interface, e.g. as used in the apparatus of FIG. 2A. It may comprise a connection point (70) to attach to the surface supplied air system using a flexible connecting element as described previously. In particular, it can be a rope that is variably attached at the connection point (70) through the use of another variable attachment link, e.g. as depicted in FIG. 5A. The control user interface has a main handle (72) for the main diver, and at least one extra handle (73) for additional divers. In the depicted embodiment, the control user interface comprises two extra handles (73) for additional divers.

The control user interface may comprise a spring-loaded reel mechanism (76) to feed out or pull in the anchor line (77). A control pin (75) may be provided on the main handle (72) that the main diver can operate to lock or release the spring-loaded reel mechanism (76). The control pin may be configured such that, when the main diver releases it, the weight of the anchor pulls out the anchor line and descends to the bottom. When the anchor is at the bottom, the main diver can then re-engage the lock and the surface supplied air system is now secured. When they are ready to continue, the main diver, from the control user interface, can pull up the anchor by pulling up the line while releasing the control pin. The spring-loaded mechanism automatically re-spools the line as the diver pulls it up.

The embodiments shown in FIGS. 2A, 2B, 2C and 6 are not to be considered limiting. A variety of alternate designs or readily available components may be considered as appropriate for use. In particular, the anchor mechanism could also be electrically controlled. In this case, the anchor mechanism itself may also be located separately from the control user interface; for instance on either the flotation device (12) or the surface supplied air system (11). Also, the connecting element (51) can be rigid, in which case it could be used to steer the propulsion system through mechanical linkages. The propulsion system could also be based on a singular, centrally located motor and propeller, or on a jet propulsion system. Further, a variety of useful data could additionally be displayed on or controlled from the control panel, either electrically or mechanically—system air pressure, remaining battery power, GPS location, speed, direction, distance covered, breathing rates of the divers, etc.

FIG. 7A shows details of on embodiment of on underwater recreation system in accordance with the present disclosure, e.g. as described above. Specifically, FIG. 7A shows a float 70 comprising six C-shaped hooks 72.

FIG. 7A shows on embodiment of a float with integrated alternating hooks. The position of the hooks may be such that the hose cannot pass straight through but instead needs to bend slightly around each hook. When the hose is pulled axially, the bends push against the hooks and create a resistance to the axial pull.

FIG. 7B shows details of on embodiment of an underwater recreation system in accordance with the present disclosure, e.g. as described above. Specifically, FIG. 7B shows on underwater recreation system comprising a float 70 and on air hose 74. As in the embodiment of FIG. 7A, float 70 of the embodiment of FIG. 7B comprises six C-shaped hooks 72 that engage air hose 74. FIG. 7C shows the embodiment of FIG. 7B from a different perspective.

In the embodiments of FIGS. 7A to 7C, the position of the hooks (72) may be such that the hose (74) cannot pass straight through but instead needs to bend slightly around each hook (72). The hooks (72) have a diameter slightly larger than the diameter of the hose (74). For example, the hose (74) may have a diameter of 16 mm, and the hooks (72) may have on inner diameter of 20 mm. The center of the radius of the inner diameter of the hooks (2) may be 7 mm off the centerline, causing a displacement in the hose (74) of 5 mm from the centerline. The hooks (72) may be spaced 24 mm apart. The spacing gives enough clearance for the hose (74) to be bent around the hooks (72) manually at the position where the hose (74) should be attached. It may be bent around each hook (72) in sequence, and then pulled axially. The axial pull tightens the bends and sets the hose (74) against the hooks (72). With additional pull, the bends push against the hooks (72) and create a resistance against the axial pull, locking the float/floating body (70) in place.

Figure 8A:
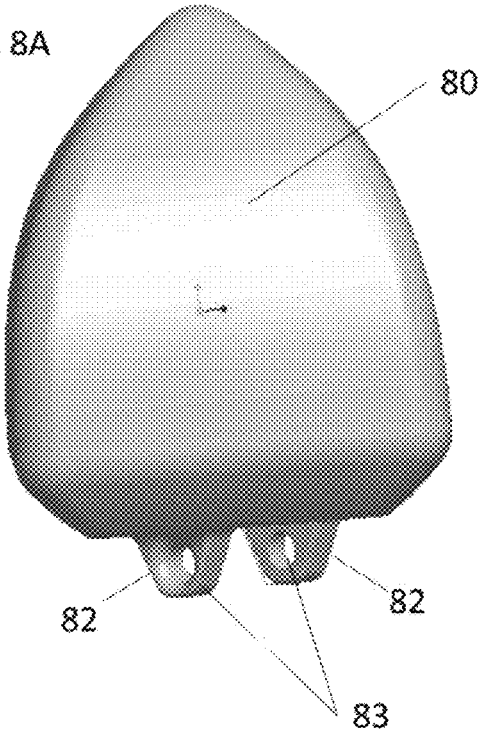
FIG. 8A shows details of on embodiment of on underwater recreation system in accordance with the present disclosure.

FIG. 8A shows details of on embodiment of on underwater recreation system in accordance with the present disclosure, e.g. as described above. Specifically, FIG. 8A shows a float 80 comprising two fin-like securing portions 82, each having a respective hole 83 therein.

FIG. 8A shows on embodiment of a float with integrated eyelets for the hose to pass through. The eyelets may be coaxial, so that the hose can pass straight through both of them unhindered. The float can easily be moved along the hose, and when the right position is established, it can be locked in place with a tether retention device/on extra retaining clip (as shown in FIGS. 8B and 8C).

As on alternate to the embodiments of FIGS. 7A to 7C, for example, the integrated attachment means of the float/depth limitation device may be a set of coaxial eyelets to feed the hose through. These may combine with on additional locking clip on the hose between the attachment points to secure the particular position of the hose. The design and material of the clip may be such that it requires a tool to spread the clip open and allow the adjustment of the hose position.

FIG. 8A shows such an embodiment of a float/depth limitation device with two coaxial eyelets (83). The embodiment comprises a main floating body/float (80) (of a depth limiting device) and integrated coaxial eyelets/holes (83). The eyelets/holes (83) may allow a hose (84) to pass straight through both of them unhindered. This allows the position of a depth limiting device to be adjusted easily.

Figure 8B:
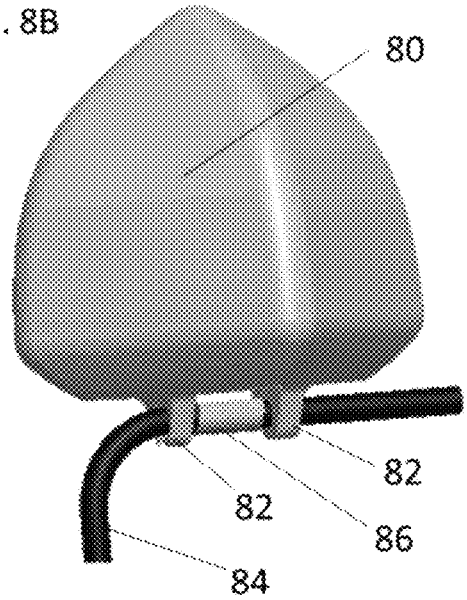
FIG. 8B shows details of on embodiment of on underwater recreation system in accordance with the present disclosure.
Figure 8C:
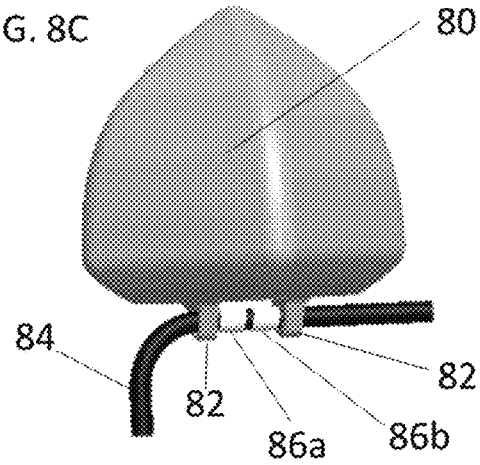
FIG. 8C shows details of on embodiment of on underwater recreation system in accordance with the present disclosure.

FIG. 8B shows details of on embodiment of on underwater recreation system in accordance with the present disclosure, e.g. as described above. Specifically, FIG. 8B shows on underwater recreation system comprising a float 80, on air hose 84 and a tether retention device in the form of a retaining clip 86. As in the embodiment of FIG. 8A, float 80 of the embodiment of FIG. 8B comprises two fin-like securing portions 82, each having a respective hole 83 therein. Air hose 84 extends/is threaded through holes 83. Retaining clip 86 clamps/dips onto air hose 84 between the two fin-like securing portions 82, thus inhibiting a sliding of air hose 84 relative to float 80 and/or fixing air hose 84 relative to float 80.

FIG. 8B shows the embodiment of FIG. 8A, albeit with a section of hose (84) in place, and a retaining clip (86) to lock the position of the float/depth limitation device on the hose (84). The desired position can then be locked in place by a retaining clip (86). The retaining clip (86) squeezes around the hose (84) with sufficient force to provide friction against any displacement due to an axial pull of the hose (84). The friction of the retaining clip (86) can be enhanced by texture or finish of the retaining clip (86), or by specially designed features in the retaining clip (86) such as small teeth. The retaining clip (86) can also be formed as two halves of a tube, with a (thumb) screw or other fastener to fix them together and clamp down on the hose.

FIG. 8C shows details of on embodiment of an underwater recreation system in accordance with the present disclosure, e.g. as described above. Specifically, FIG. 8C shows an underwater recreation system comprising a float 80, on air hose 84 and two tether retention device in the form of respective retaining clips 86A and 86B. As in the embodiment of FIG. 8A, float 80 of the embodiment of FIG. 8C comprises two fin-like securing portions 82, each having a respective hole 83 therein. Air hose 84 extends/is threaded through holes 83. Retaining clips 86A and 86B clamp/clip onto air hose 84 between the two fin-like securing portions 82, thus inhibiting a sliding of air hose 84 relative to float 80.

FIG. 8C shows the embodiment of FIG. 8A, albeit with a section of hose (84) in place. But in contrast to the embodiment of FIG. 8B, the hose is locked in place with two narrower retaining clips (86). The two narrower retaining clips (86) give an added level of redundancy against failure, and allow smaller, more standard clamps to be used with the some wide span between the eyelets/holes (83).

Figure 9A:
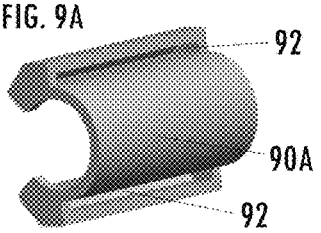
FIG. 9A shows on embodiment of a retaining clip in accordance with the present disclosure.

FIG. 9A shows an embodiment of a retaining clip 90A in accordance with the present disclosure, e.g. as described above. Specifically, FIG. 9A shows a retaining clip 90A having a C-shaped cross-section and comprising two engagement portions 92 on an outer diameter of retaining clip 90A, e.g. for receiving a tool for (elastically) dilating retaining clip 90A.

FIG. 9A shows an embodiment of a (wider) retaining clip (90A), e.g. as used in the embodiment shown in FIG. 8B. The retaining clip has two engagement portions in the form of pockets (92) specially designed for a flat nosed spreader tool. The spreader tool can be used to spread the retaining clip (90A) and insert or remove it. The force to spread the retaining clip (90A) open can be designed in such a way that it is difficult or even impossible for a person the remove it without the spreader tool. In this way, only the adult or designated guide, i.e. an experienced diver, can alter the position of the depth limitation device.

Figure 9B:
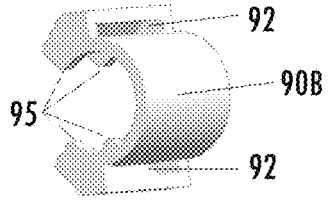
FIG. 9B shows on embodiment of a retaining clip in accordance with the present disclosure.

FIG. 9B shows on embodiment of a retaining clip 90B in accordance with the present disclosure, e.g. as described above. Specifically, FIG. 9B shows a retaining clip 90B comprising two engagement portions 92 on an outer diameter of retaining clip 90B, e.g. for receiving a tool for (elastically) dilating retaining clip 90B. Retaining clip 90B has a C-shaped cross-section and comprises teeth 95 on an inner diameter of retaining clip 90B, e.g. for inhibiting a sliding of retaining clip 90B relative to a tether.

FIG. 9B shows on embodiment of a (narrow) retaining clip (90B), e.g. as used in the embodiment shown in FIG. 8C. The retaining clip has two engagement portions in the form of pockets (92) specially designed for a flat nosed spreader tool. The spreader tool can be used to spread the retaining clip (90B) and insert or remove it. The force to spread the retaining clip (90B) open can be designed in such a way that it is difficult or even impossible for a person the remove it without the spreader tool. Retaining clip 90B may have a C-shaped cross-section and may comprise teeth 95 on an inner diameter of retaining clip 90B, e.g. for inhibiting a sliding of retaining clip 90B relative to a tether.

Figure 9C:
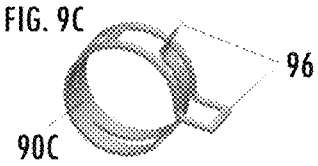
FIG. 9C shows on embodiment of a retaining clip in accordance with the present disclosure.

FIG. 9C shows on embodiment of a retaining clip 90C in accordance with the present disclosure, e.g. as described above. Specifically, FIG. 9C shows a retaining clip 90C that extends more than 360°, e.g. for extending around on outer circumference of a tether. Retaining clip 90C comprises two finger tabs 96 on an outer diameter of retaining clip 90C, namely a finger tab 96 at each respective end of retaining clip 90C. Finger tabs 96 may facilitate a (manual) squeezing action for dilating (on inner diameter) the retaining clip.

FIG. 9C shows on embodiment of a retaining clip 90C similar in design to a standard hose clamp. In this case, depending on the design of the clamp and materials, the tabs (96) can be squeezed by hand to open the diameter of the clamp and allow the hose to pass through freely. Releasing the tabs (96) closes the diameter again and squeezes the hose to provide the retaining friction. With a stiffer design and materials, the force can be designed to be so great that a set of pliers are necessary to squeeze the tabs (96), again ensuring that only the adult or designated guide can alter the position of the depth limitation device.

In the present disclosure, the verb "may" is used to designate optionality/noncompulsoriness. In other words, something that "may" can, but need not. In the present disclosure, the verb "comprise" may be understood in the sense of including. Accordingly, the verb "comprise" does not exclude the presence of other elements/actions. In the present disclosure, relational terms such as "first," "second," "top," "bottom" and the like may be used solely to distinguish one entity or action from another entity or action without necessarily requiring or implying any actual such relationship or order between such entities or actions.

In the present disclosure, the term "any" may be understood as designating any number of the respective elements, e.g. as designating one, at least one, at least two, each or all of the respective elements. Similarly, the term "any" may be understood as designating any collection(s) of the respective elements, e.g. as designating one or more collections of the respective elements, a collection comprising one, at least one, at least two, each or all of the respective elements. The respective collections need not comprise the some number of elements.

In the present disclosure, the expression "at least one" is used to designate any (integer) number or range of (integer) numbers (that is technically reasonable in the given context). As such, the expression "at least one" may, inter alia, be understood as one, two, three, four, five, ten, fifteen, twenty or one hundred. Similarly, the expression "at least one" may, inter alia, be understood as "one or more," "two or more" or "five or more."

In the present disclosure, expressions in parentheses may be understood as being optional. As used in the present disclosure, quotation marks may emphasize that the expression in quotation marks may also be understood in a figurative sense. As used in the present disclosure, quotation marks may identify a particular expression under discussion.

In the present disclosure, many features are described as being optional, e.g. through the use of the verb "may" or the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of the invention, even those disclosed solely in combination with other features of the invention, may be combined in any configuration excepting those readily apparent to the person skilled in the art as nonsensical. Likewise, use of the singular and plural is solely for the sake of illustration and is not to be interpreted as limiting. Except where the contrary is explicitly noted, the plural may be replaced by the singular and vice-verse.

The embodiments disclosed hereinabove may be summarized as follows.

Embodiment 1

An underwater recreation system, comprising:

a first float;

a first tether;

a first interconnect that limits a range of movement of a first end of said first tether to within one meter of said first float; and a second interconnect that limits a range of movement of said first end of said first tether to within four meters of said first float.

Embodiment 2

The underwater recreation system of Embodiment 1, comprising:

a third interconnect that limits a range of movement of said first end of said first tether to within seven meters of said first float.

Embodiment 3

An underwater recreation system, comprising:

a first float;

a first tether connected to said first float;

a first depth limiter connected to said first tether, on interconnection of said first depth limiter and said first tether limiting a range of movement of said first depth limiter to within one meter of said first float; and a second depth limiter connected to said first tether, on interconnection of said second depth limiter and said first tether limiting a range of movement of said second depth limiter to within four meters of said first float.

Embodiment 4

The underwater recreation system of Embodiment 3, comprising:

a third depth limiter connected to said first tether, on interconnection of said third depth limiter and said first tether limiting a range of movement of said third depth limiter to within seven meters of said first float.

Embodiment 5

The underwater recreation system of any one of the previous Embodiments, comprising:

a first harness connectable to said first tether at a dorsal region of said first harness.

Embodiment 6

An underwater recreation system, comprising:

a first float;

a first harness;

a first depth limiting system connectable to a dorsal region of said first harness that limits a range of movement of said first harness to within one meter of said first float; and a second depth limiting system connectable to a dorsal region of said first harness that limits a range of movement of said first harness to within four meters of said first float.

Embodiment 7

The underwater recreation system of Embodiment 6, comprising:

a third depth limiting system connectable to a dorsal region of said first harness that limits a range of movement of said first harness to within seven meters of said first float.

Embodiment 8

An underwater recreation system, comprising:

a first float;

a first harness; and an adjustable depth limiting system that connects said first float to a dorsal region of said first harness and limits a range of movement of said first harness relative to said first float.

Embodiment 9

The underwater recreation system of any one of Embodiments 5 to 8, wherein:

a clasp for closing said first harness is provided at said dorsal region.

Embodiment 10

The underwater recreation system of any one of Embodiments 5 to 9, comprising:

a second harness; and a first range limitation system that limits a range of movement of said first harness relative to said second harness.

Embodiment 11

The underwater recreation system of any one of Embodiments 5 to 9, comprising:

a second float; and a second range limitation system that limits a range of movement of said first float relative to said second float.

Embodiment 12

The underwater recreation system of Embodiment 11, wherein:

said first range limitation system and said second range limitation system shore at least a portion of a tether.

Embodiment 13

The underwater recreation system of Embodiment 11 or 12, wherein:

said first range limitation system comprises a fastener adjustably secured to a tether of said second range limitation system.

Embodiment 14

The underwater recreation system of any one of the previous Embodiments, wherein:

said first float has a buoyancy of less than 10 kilograms.

Embodiment 15

The underwater recreation system of any one of the previous Embodiments, wherein:

said first tether is an air hose.

Embodiment 16

The underwater recreation system of any one of the previous Embodiments, comprising:

a second float comprising at least one component selected from the group consisting of a flag mount, a diver awareness flag, a propulsion system, an air compressor, a compressed air tank, an anchor system, a propulsion control system, on anchor control system and a tow bar.

Embodiment 17

The underwater recreation system of Embodiment 16, comprising:

a control system for controlling at least one of said propulsion system and said anchor system, said control system being operable from underwater by a diver.

Embodiment 18

The underwater recreation system of Embodiment 17, wherein:

said control system comprises a spring-loaded reel mechanism for reeling in an anchor line of said anchor system.

Embodiment 19

The underwater recreation system of any one of Embodiments 16 to 18, comprising:

a second range limitation system that limits a range of movement of said first float relative to said second float.

Embodiment 20

The underwater recreation system of any one of Embodiments 16 to 19, wherein:

said tow bar is connected to said second float and comprises a grip region for receiving at least one hand of each of at least two submerged divers.

Embodiment 21

The underwater recreation system of any one of Embodiments 16 to 20, wherein:

said tow bar comprises a control system for controlling at least one of said propulsion system and said anchor system, said control system being operable from underwater by a diver.

Embodiment 22

The underwater recreation system of any one of Embodiments 16 to 17 and 19 to 20, wherein:

said tow bar comprises a spring-loaded reel mechanism for reeling in on anchor line of said anchor system.

Embodiment 23

The underwater recreation system of any one of the previous Embodiments, wherein:

said first float comprises a plurality of hooks for securing a tether to said first float.

Embodiment 24

The underwater recreation system of any one of the previous Embodiments, comprising:

a retaining clip, wherein:

said first float comprises at least two holes, a tether of said underwater recreation system extending through said at least two holes, and said retaining clip is clipped to a portion of said tether intermediate said at least two holes.

Embodiment 25

An underwater recreation system, comprising:

a float;

at least one of a propulsion system for propelling said float and on anchor system for anchoring said float; and a control system for controlling at least one of said propulsion system and said anchor system, said control system being operable from underwater by a diver.

Embodiment 26

The underwater recreation system of Embodiment 25, comprising:

a tow bar connected to said float, said tow bar having a grip region for receiving at least one hand of each of at least two submerged divers.

Embodiment 27

The underwater recreation system of Embodiment 26, wherein:

said tow bar comprises said control system.

Embodiment 28

The underwater recreation system of Embodiment 26 or 27, wherein:

said tow bar comprises a spring-loaded reel mechanism for reeling in on anchor line of said anchor system.

Embodiment 29

A method of diving instruction, comprising:

limiting a diving depth of a first diver to a first depth by tethering said first diver to a first float; and limiting a diving depth of a second diver of higher diving proficiency than said first diver to a second depth deeper than said first depth by tethering said second diver to a second float.

Embodiment 30

The method of Embodiment 29, wherein:

said first depth is less than one meter below a water surface; and said second depth is less than four meters below a water surface.

Embodiment 31

The method of Embodiment 29 or 30, comprising at least one of:

securing a tether to a dorsal region of a harness worn by said first diver; and securing a tether to a dorsal region of a harness worn by said second diver.

Embodiment 32

The method of any one of Embodiments 29-31, comprising at least one of:

limiting a distance between said first diver and another diver; and limiting a distance between said second diver and another diver.

Embodiment 33

The method of any one of Embodiments 29-32, comprising at least one of:

determining, prior to said limiting said diving depth of said first diver to said first depth, a proficiency of said first diver to swim, and determining, prior to said limiting said diving depth of said second diver to said second depth, a proficiency of said second diver to remove and replace a regulator/mouthpiece underwater.

Embodiment 34

The method of any one of Embodiments 29-33, comprising:

limiting a diving depth of a third diver of higher diving proficiency than said second diver to a third depth deeper than said second depth by tethering said third diver to a third float.

Embodiment 35

The method of Embodiment 34, wherein:

said third depth is less than seven meters below a water surface.

Embodiment 36

The method of Embodiment 34 or 35, comprising:

determining, prior to said limiting said diving depth of said third diver to said third depth, a proficiency of said third diver to equalize ear pressure underwater and ascend at a controlled rate in the range of 6 to 18 meters per minute.

Embodiment 37

A method of diving instruction, comprising:

limiting a diving depth of a first diver to a first depth by tethering said first diver to a first float; and limiting a distance between said first diver and another diver.

Embodiment 38

The method of Embodiment 37, wherein:

said first diver is tethered to said first float using an air hose that supplies compressed air to said first diver.

Embodiment 39

The method of Embodiment 37 or 38, wherein:

said limiting a distance comprises tethering said another diver to said first diver via said first float.

Embodiment 40

The method of Embodiment 39, wherein:

said another diver is tethered to said first diver using an air hose that supplies compressed air to said another diver and an air hose that supplies compressed air to said first diver.

Embodiment 41

The method of Embodiment 37 or 38, comprising:

limiting a distance between said another diver and said first float by tethering said another diver to said first float via said first diver.

Embodiment 42

The method of any one of Embodiments 37-41, wherein:

said first depth is less than one meter below a water surface.

Embodiment 43

An underwater recreation system comprising:

a main floating support;

a separate surface floating depth limiting device;

a connecting line to connect the surface floating depth limiting device to a beginner diver; and a means for variably attaching the connecting line to the beginner diver in such a way that they cannot change or detach it themselves.

Embodiment 44

The underwater recreation system of Embodiment 43, further having another connecting line to an advanced diver and a means for variably attaching this connecting line to the beginner diver in such a way that they cannot change or detach it themselves.

Embodiment 45

The underwater recreation system of Embodiment 43, wherein the main floating support supports a surface supplied air system.

Embodiment 46

The underwater recreation system of Embodiment 45, wherein the hoses of the surface supplied air system are used as the connecting lines.

Embodiment 47

The underwater recreation system of Embodiment 45, with separate hoses for the beginner and advanced diver, where a range control element can be variably positioned between the hoses to limit the range between them, and a floating depth control element can be variably positioned on the beginner diver's hose to limit the maximum depth they can go.

Embodiment 48

The underwater recreation system of Embodiment 47, where the hoses are foreseen with specifically spaced attachment points for the attachment of the depth control and range control Embodiment 49

The underwater recreation system of Embodiment 47, where the range control element can be positioned in the range 0.1 M to 7.0 m from both divers, and the depth control element can be positioned in the range 0.1 M to 5.0 M Embodiment 50

An underwater recreation system comprising:
a main floating support that supports a surface supplied air system;
a control system;
an anchoring system; and
an underwater user interface for that control system that is underwater and can be operated to release or retrieve the anchor while remaining underwater.

Embodiment 51

An underwater recreation system comprising:
a main floating support that supports a surface supplied air system;
a control system; and
an underwater user interface for that control system that can be variably fixed to operate at a plurality of different depths underwater and can be operated while remaining underwater.

Embodiment 52

The underwater recreation system of Embodiment 51 wherein the control system controls a propulsion system Embodiment 53

The underwater recreation system of Embodiment 51 wherein the control system controls an anchoring system Embodiment 54

The underwater recreation system of Embodiment 51 wherein the underwater user interface has means for additional divers to hold on and be towed through the water at specific depths Embodiment 55

The underwater recreation system of Embodiment 51 wherein the plurality of different depths for the underwater user interface attachment points are in the range of 0.5 M-5.0 M Embodiment 56

A method for an adult or a child to learn proper safety techniques for underwater breathing and behavior and become fully comfortable with them, comprising:
creating a series of diving learning steps at incrementally deeper depths; and
limiting the learning diver to particular, varying maximum depths through the use of a surface floating depth limitation device Embodiment 57

The method of Embodiment 56, wherein the series of learning steps are further broken down by variable ranges of independent motion away from a main advanced diver through the use of a range control limitation device Embodiment 58

The method of Embodiment 56, wherein the incrementally deeper depths are in the range of 0 m-5 m.

Embodiment 59

The method of Embodiment 56, wherein a substantial time posses between each of the incremental depth steps, so that the learning diver can practice the techniques of their current step to such an extent that the techniques are ingrained as a natural reaction.

The invention claimed is:

1. A method of instruction to teach a learning user SCUBA techniques for proper underwater breathing, and establish a feeling of natural behaviors and comfort for breathing underwater through a pressure regulating device, comprising:
providing a surface floating air supply for breathing underwater through a pressure regulating device;
providing the learning user with a series of learning steps with diving techniques and instructions to practice at incrementally deeper depths under supervision of an instructor;
providing a surface floating depth limitation device connected to the user and spaced away from the surface floating air supply to allow the user to swim freely in any direction within a specified horizontal range, wherein the depth limitation device is configured to selectively vary a distance between the depth limitation device and the user, thereby adjustably restricting the user to a predetermined maximum allowable depth corresponding to the respective learning step; and
allowing the user to complete each learning step independent of the next step and after completion, practice it without an instructor before proceeding onto the next step.

2. The method of claim 1, further comprising:
providing breathing air from the surface floating air supply for an experienced diver to join the learning user underwater;
providing a series of learning steps that are further broken down by the range of independent motion away from the experienced diver; and
providing a mechanical means to restrict the learning user to the particular maximum range of their learning step.

3. The method of claim 2, wherein the surface floating air supply comprises a flexible breathing hose sufficiently long to reach the learning user underwater and a second flexible breathing hose sufficiently long to reach the experienced diver underwater, and the mechanical means for restricting the range of the learning user attaches to the two breathing hoses.

4. The method of claim 3, wherein the mechanical means for restricting the range of the learning user can be variably attached at multiple locations along one or both of the hoses.

5. The method of claim 1, wherein the surface floating air supply comprises at least one flexible breathing hose sufficiently long to reach the learning user underwater, and wherein the surface floating depth limitation device attaches to said breathing hose.

6. The method of claim 5, wherein the surface floating air supply floats freely at the surface and is pulled along by the user as they swim.

7. The method of claim 6, further comprising the step of providing a second flexible breathing hose for an experienced diver to accompany and either guide or observe the learning user.

8. The method of claim 5, wherein the surface floating depth limitation device can be variably attached at multiple locations along the breathing hose.

9. The method of claim 1, wherein at least two of the incrementally deeper depths are in the range of 0.5 m to 7 m.

10. The method of claim 9, wherein the learning user is restricted to their particular maximum depth of each step by the surface floating depth limitation device for a preset number of dives, and is permitted to advance to the next step and depth limit only after documenting the required number of dives.

11. The method of claim 1, comprising the step of teaching slow ascend while surfacing, and restricting the learning user to a particular maximum depth in the range of 0.5 m to 3 m.

* * * * *